US011759689B2

(12) United States Patent
Jordan

(10) Patent No.: US 11,759,689 B2
(45) Date of Patent: Sep. 19, 2023

(54) RUNNING FORM TRAINING DEVICE

(71) Applicant: Shawn Jordan, Royce City, TX (US)

(72) Inventor: Shawn Jordan, Royce City, TX (US)

( * ) Notice: Subject to any disclaimer, the term of this patent is extended or adjusted under 35 U.S.C. 154(b) by 26 days.

(21) Appl. No.: 17/545,223

(22) Filed: Dec. 8, 2021

(65) Prior Publication Data

US 2023/0173365 A1 Jun. 8, 2023

(51) Int. Cl.

| | |
|---|---|
| ***A63B 69/00*** | (2006.01) |
| ***A63B 21/00*** | (2006.01) |
| ***A63B 21/04*** | (2006.01) |
| ***A63B 21/055*** | (2006.01) |
| ***A63B 23/12*** | (2006.01) |
| ***A63B 23/035*** | (2006.01) |

(52) U.S. Cl.

CPC ..... *A63B 69/0028* (2013.01); *A63B 21/0442* (2013.01); *A63B 21/0557* (2013.01); *A63B 21/4007* (2015.10); *A63B 21/4009* (2015.10); *A63B 21/4021* (2015.10); *A63B 23/03541* (2013.01); *A63B 23/12* (2013.01); *A63B 69/0059* (2013.01); *A63B 2209/10* (2013.01); *A63B 2214/00* (2020.08)

(58) Field of Classification Search

CPC ..... A63B 21/02–0557

See application file for complete search history.

(56) References Cited

U.S. PATENT DOCUMENTS 1,402,179 A 1/1922 Piscitelli
2,097,376 A * 10/1937 Marshman ..... A63B 21/0004 482/124
4,993,703 A 2/1991 Tolle
5,306,222 A * 4/1994 Wilkinson ..... A63B 23/03508 482/121
5,362,295 A * 11/1994 Nurge ..... A63B 21/4013 482/121
5,518,480 A 5/1996 Frappier
5,647,827 A * 7/1997 Gutkowski ..... A63B 21/4025 482/122
5,683,336 A * 11/1997 Pape ..... A63B 23/03541 482/121
5,813,955 A * 9/1998 Gutkowski ..... A63B 21/4007 482/121
5,993,362 A * 11/1999 Ghobadi ..... A63B 69/004 482/121
7,147,590 B2 12/2006 Toven
7,325,254 B1 * 2/2008 Edgar ..... A63B 21/0552 2/102

(Continued)

FOREIGN PATENT DOCUMENTS

WO WO9605890 2/1996

*Primary Examiner* — Nyca T Nguyen

(57) ABSTRACT

A running form training device for training a runner to properly position and move their arms includes a harness, a pair of bands, and a pair of cuffs. The harness can be donned by a user so that the harness is removably engaged to a torso of the user. The bands are resiliently stretchable. Each band is engaged to the harness so that the band extends from proximate to a front of a respective shoulder of the user. Each cuff is engaged to a first end of a respective band and is removably engageable to a respective wrist of the user. The bands draw the arms of the user toward the harness, thereby restricting movement and positioning of the arms to promote proper running form.

8 Claims, 6 Drawing Sheets

(56) References Cited

U.S. PATENT DOCUMENTS 7,608,026 B1 * 10/2009 Nicassio ..... A63B 21/4015 482/121
7,998,034 B1 8/2011 Cobo
8,678,983 B1 * 3/2014 Brown ..... A63B 23/03541 482/131
D732,118 S 6/2015 Hamilton
9,061,173 B1 * 6/2015 Felkel ..... A63B 69/0059
10,195,475 B2 * 2/2019 Schreiber ..... A63B 21/00061
10,207,139 B2 * 2/2019 Brancato ..... A63B 21/4025
10,286,249 B1 * 5/2019 Sibhatu ..... A63B 21/0552
10,328,234 B2 6/2019 Garcia Molina
10,328,324 B1 * 6/2019 Case ..... G09B 19/0038
10,857,414 B1 * 12/2020 Lopez ..... A63B 21/4035
11,331,529 B1 * 5/2022 Cranke ..... A63B 21/4021
2002/0193188 A1 * 12/2002 Wah Loh ..... A63B 69/38 473/215
2005/0107222 A1 * 5/2005 Toven ..... A63B 69/0059 482/91
2005/0282689 A1 * 12/2005 Weinstein ..... A63B 21/0552 482/121
2006/0040805 A1 * 2/2006 Wilkinson ..... A63B 21/4007 482/124
2007/0083975 A1 * 4/2007 Senegal ..... A63B 21/4017 2/102
2010/0222189 A1 * 9/2010 Washington ..... A63B 21/4001 482/124
2013/0143723 A1 * 6/2013 Bender ..... A63B 21/02 482/121
2013/0333097 A1 * 12/2013 Cranke ..... A63B 21/0557 2/300
2015/0065317 A1 * 3/2015 Washington ..... A63B 23/14 482/124
2017/0028244 A1 * 2/2017 Schreiber ..... A63B 21/4025
2017/0106223 A1 * 4/2017 Brancato ..... A63B 21/0557
2018/0021624 A1 * 1/2018 Cordero ..... A63B 21/154 601/48
2019/0001179 A1 * 1/2019 Mela ..... A63B 21/4005
2019/0105524 A1 * 4/2019 Whitaker ..... A63B 23/1209
2020/0269082 A1 * 8/2020 Desrosiers ..... A63B 21/4007
2020/0335005 A1 * 10/2020 Green ..... G09B 19/0015
2020/0338386 A1 * 10/2020 Park ..... A63B 71/0054
2022/0241638 A1 * 8/2022 Peery ..... A63B 21/0555
2022/0264967 A1 * 8/2022 Bassoo ..... A63B 21/0088

* cited by examiner

RUNNING FORM TRAINING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to training devices and more particularly pertains to a new training device for training a runner to properly position and move their arms. The present invention discloses a training device comprising a chest worn harness having a pair of arm cuffs tethered singly to each side of the harness with resiliently stretchable bands, wherein the bands draw the arms towards the harness and restrict the movement and position of the arms.

(2) Description of Related Art Including Information Disclosed Under 37 CFR 1.97 and 1.98

The prior art relates to training devices. Prior art training devices may comprise two pairs of nonelastic straps, with one nonelastic strap of each pair extending between a respective hand of a user to a harness positioned on a torso of the user, and the other nonelastic strap extending between an associated upper arm and the harness, such that a range of motion of the arm is limited. The prior art also includes muscle strengthening devices that comprise resiliently stretchable straps, either fitted with handles for grasping or with cuffs that are attachable to arms of a user, with the resiliently stretchable straps extending to a harness positioned on a torso of the user. What is lacking in the prior art is a training device comprising a chest worn harness having a pair of arm cuffs tethered singly to each side of the harness with resiliently stretchable bands, wherein the bands draw the arms towards the harness and restrict the movement and position of the arms.

BRIEF SUMMARY OF THE INVENTION

An embodiment of the disclosure meets the needs presented above by generally comprising a harness, a pair of bands, and a pair of cuffs. The harness is configured to be donned by a user so that the harness is removably engaged to a torso of the user. The bands are resiliently stretchable. Each band is engaged to the harness so that the band extends from proximate to a front of a respective shoulder of the user. Each cuff is engaged to a first end of a respective band and is configured to removably engage a respective wrist of the user. The bands are configured to draw the arms of the user toward the harness, thereby restricting movement and positioning of the arms to promote proper running form.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
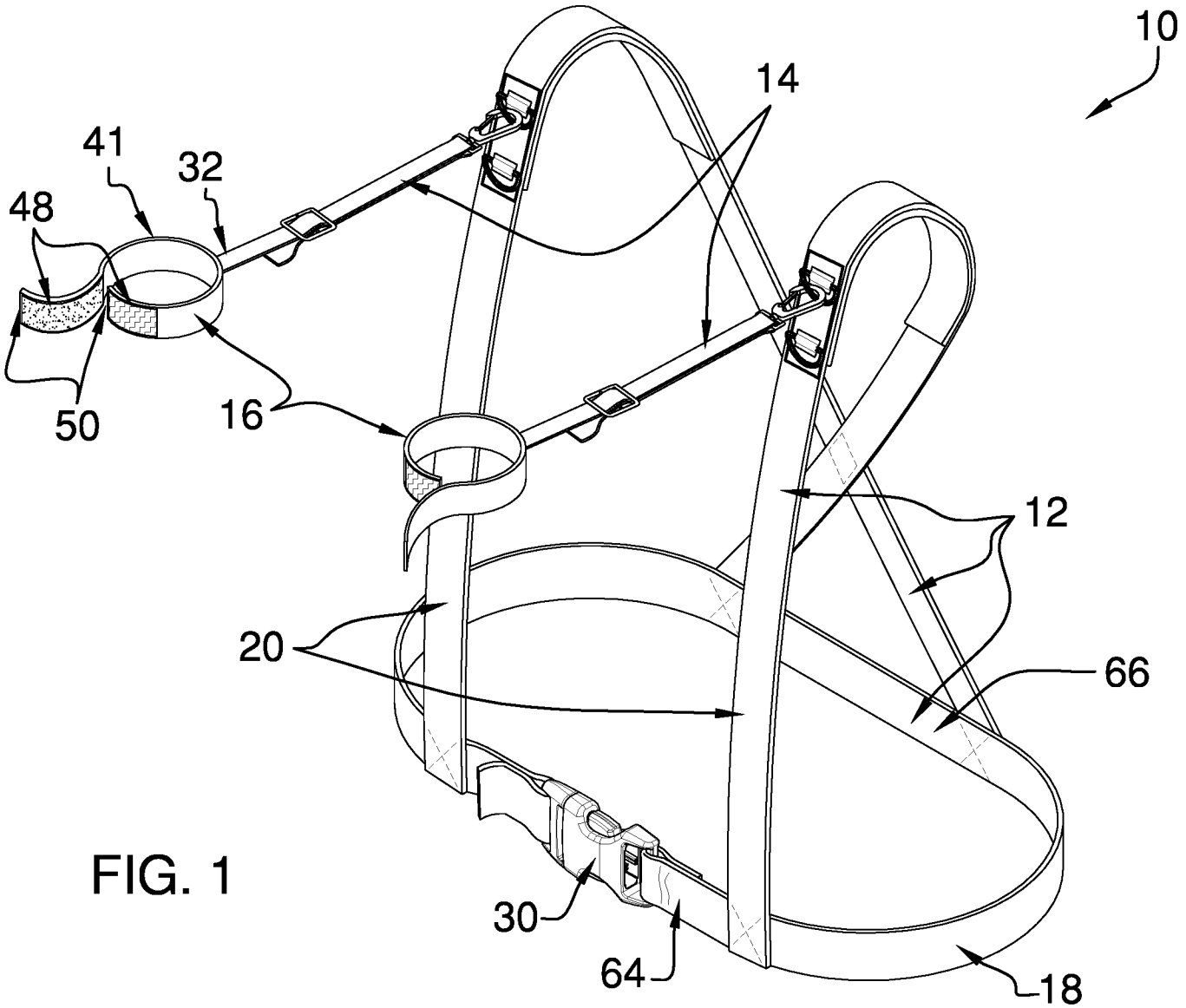
FIG. 1 is an isometric perspective view of a running form training device according to an embodiment of the disclosure.

With reference now to the drawings, and in particular to FIGS. 1 through 6 thereof, a new training device embodying the principles and concepts of an embodiment of the disclosure and generally designated by the reference numeral 10 will be described.

As best illustrated in FIGS. 1 through 6, the running form training device 10 generally comprises a harness 12, a pair of bands 14, and a pair of cuffs 16. The harness 12 is configured to be donned by a user so that the harness 12 is removably engaged to a torso of the user. The harness 12 may comprise a belt 18 and a pair of chest straps 20, or be of an alternative configuration, such as, but not limited to, vests, jackets, and the like.

The belt 18 is configured to be tightened around a waist of the user. A first coupler 22 and a second coupler 24 are engaged to a first endpoint 26 and a second endpoint 28 of the belt 18, respectively. The second coupler 24 is complementary to the first coupler 22 so that the second coupler 24 is selectively engageable to the first coupler 22 to fasten the belt 18 around the waist of the user. The second coupler 24 and the first coupler 22 may comprise a side release buckle 30 so that the belt 18 is selectively sizable to fit the waist of the user. The second coupler 24 and the first coupler 22 also may comprise other coupling means, such as, but not limited to, clamp closure buckles, hook and loop couplers, and the like.

Figure 3:
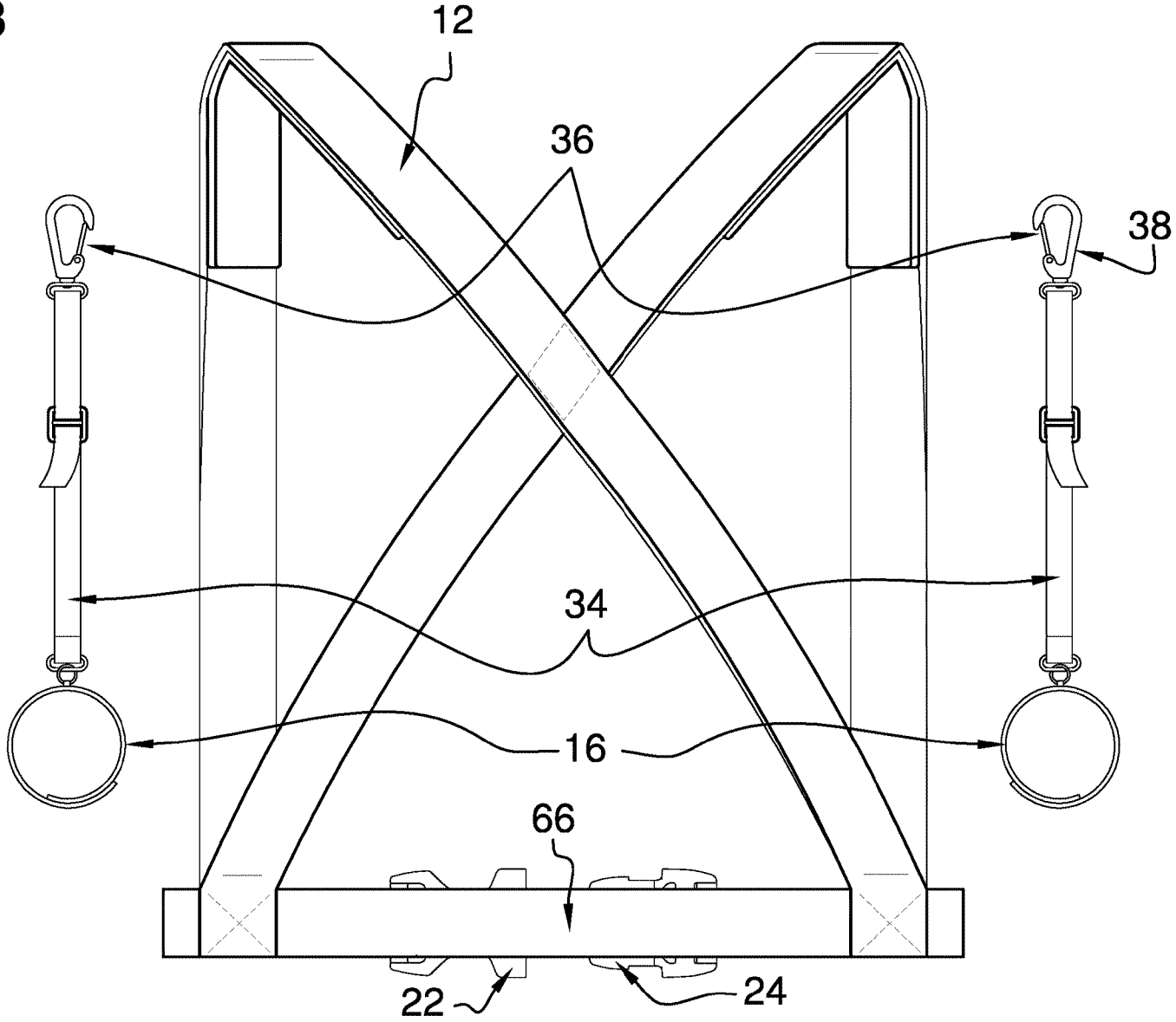
FIG. 3 is a rear view of an embodiment of the disclosure.
Figure 4:
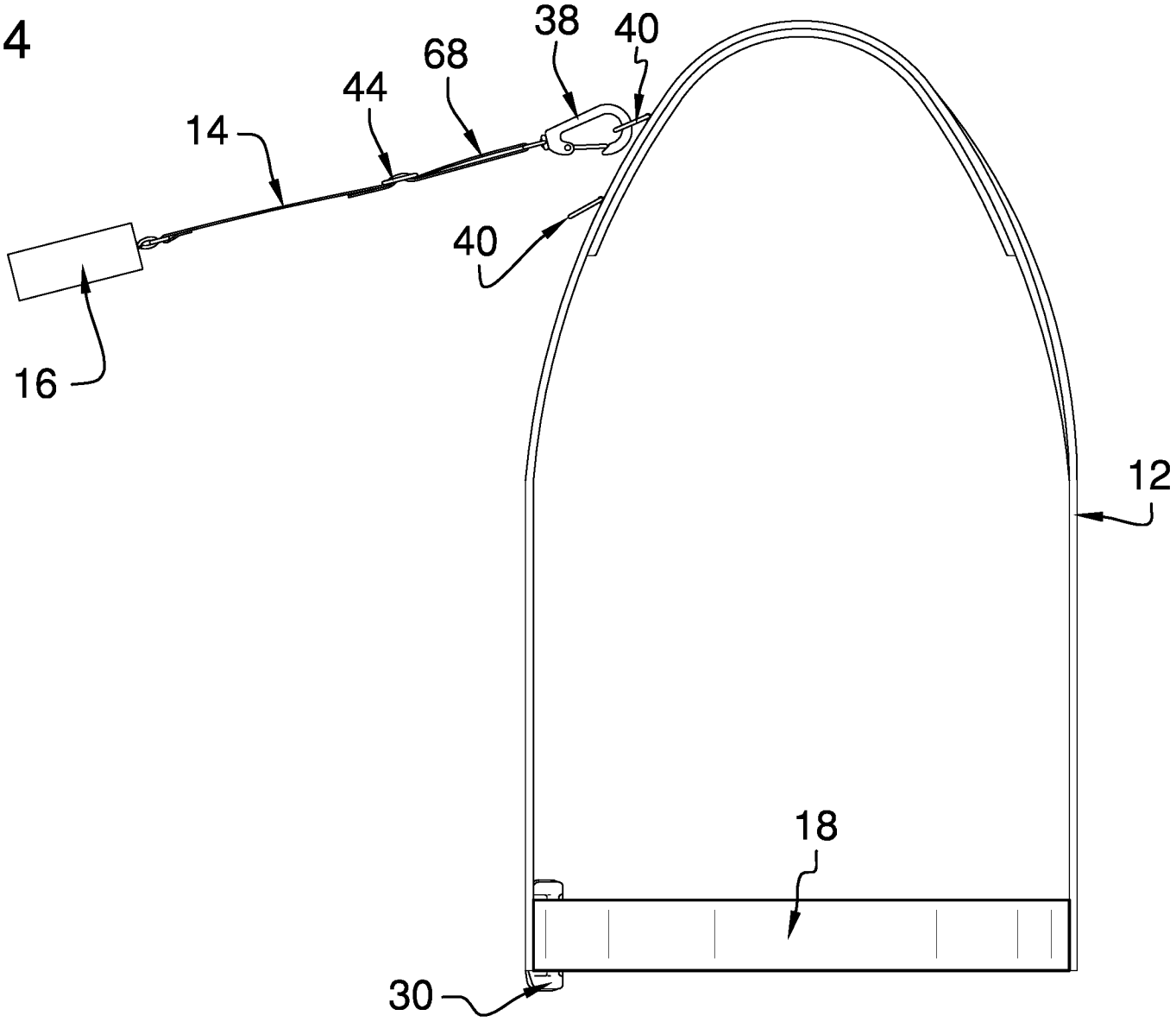
FIG. 4 is a side view of an embodiment of the disclosure.
Figure 5:
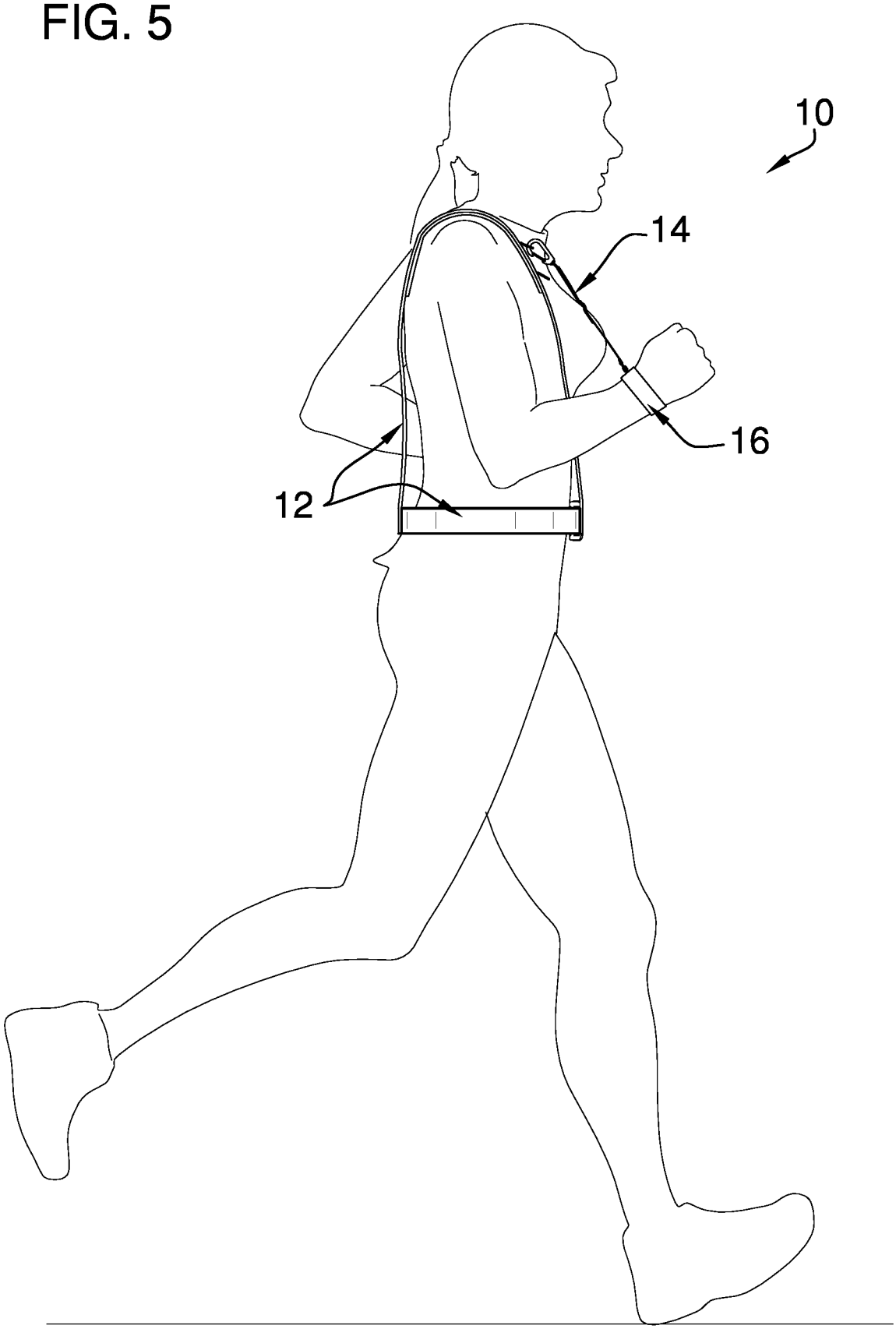
FIG. 5 is an in-use view of an embodiment of the disclosure.
Figure 6:
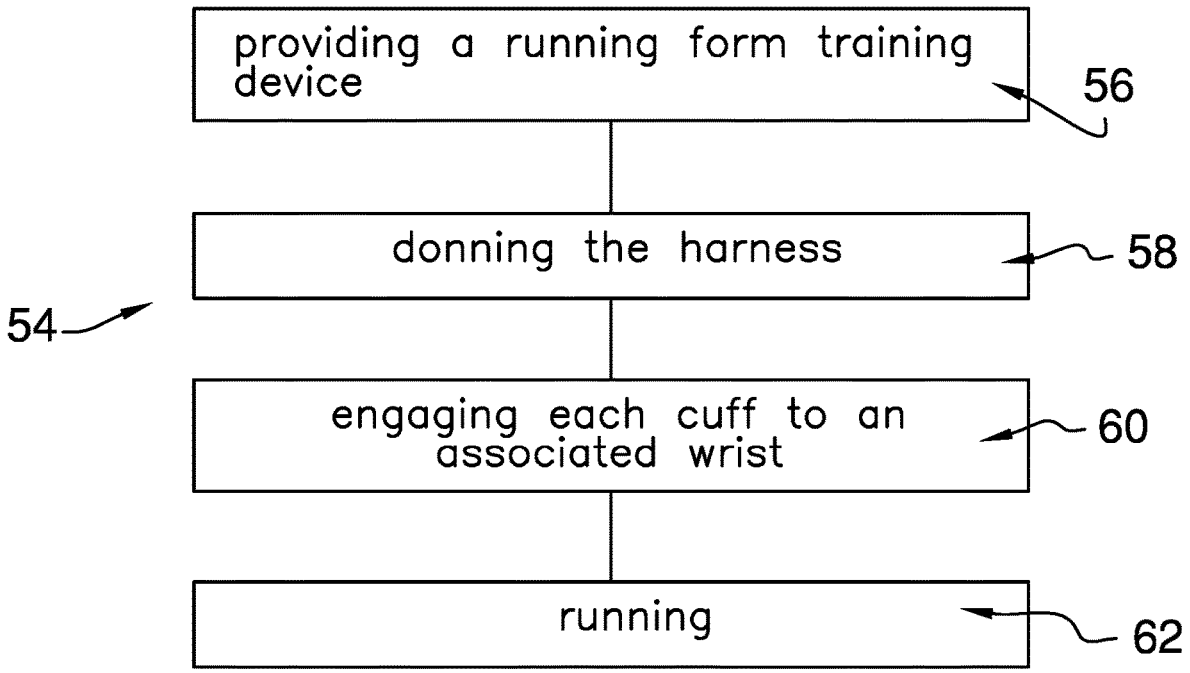
FIG. 6 is a flow diagram for a method utilizing an embodiment of the disclosure.

Each chest strap 20 extends from a forward section 64 to a rearward section 66 of the belt 18. The chest straps 20 may be mutually engaged, as shown in FIG. 3, so that each chest strap 20 extends transversely across a back of the user.

The bands 14 comprise elastomer, silicone, rubber, or the like, and thus are resiliently stretchable. Each band 14 is engaged to the harness 12 so that the band 14 extends from proximate to a front of a respective shoulder of the user. Each cuff 16 is engaged to a first end 32 of a respective band 14 and is configured to removably engage a respective wrist of the user. The bands 14 are configured to draw the arms of the user toward the harness 12, thereby restricting movement and positioning of the arms to promote proper running form.

Figure 2:
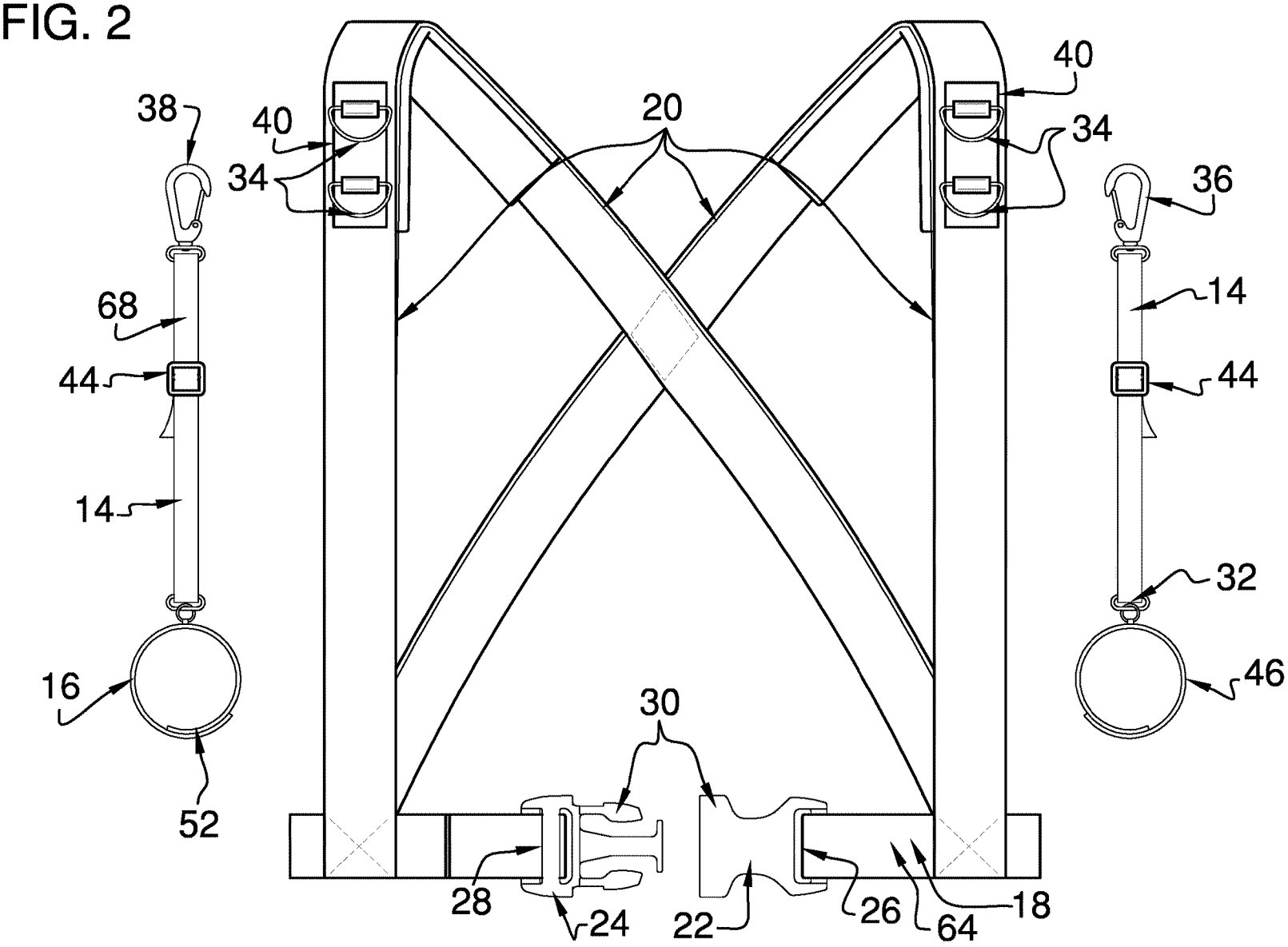
FIG. 2 is a front view of an embodiment of the disclosure.

A plurality of first connectors 34 is engaged to the chest straps 20, as shown in FIG. 2. The plurality of first connectors 34 may comprise four first connectors 34 positioned two-apiece on each chest strap 20, or other number of first connectors 34, such as, but not limited to, six first connectors 34 positioned three-apiece on each chest strap 20, eight first connectors 34 positioned four-apiece on each chest strap 20, and the like. Each of a pair of second connectors 36 is engaged to a respective band 14. The second connector 36 is complementary to the first connectors 34 so that the second connector 36 is selectively engageable to a respective first connector 34 to removably engage the respective band 14 to the harness 12. The second connector 36 may comprise a carabiner 38, and the respective first connector 34 may comprise a D-ring 40. The present invention anticipates the second connector 36 and the respective first connector 34 comprising other connecting pairs, such as, but not limited to, snap connectors, side release buckles, and the like.

Each of a pair of slip rings 42 is engaged to a respective second connector 36. A respective band 14 is positioned through the slip ring 42. Each of a pair of slide buckles 44 is engaged to a respective band 14 to define a loop 68 so that the respective band 14 is engaged to a respective slip ring 42. The slide buckle 44 also renders the respective band 14 selectively length adjustable.

The cuff 16 comprises a wrist strap 46 and a pair of fasteners 48. Each fastener 48 is engaged to the wrist strap 46 proximate to a respective opposed end 50 of the wrist strap 46. The fasteners 48 are selectively mutually engageable to fasten the cuff 16 around the respective wrist of the user. The pair of fasteners 48 may comprise a hook and loop fastener 52 so that the cuff 16 is selectively sizable to fit the respective wrist of the user. The pair of fasteners 48 also may comprise other fastening means, such as, but not limited to, buckles, snap closures, and the like.

In use, the running form training device 10 enables a method 54 of training proper running form. The method comprises a first step 56 of providing a running form training device 10 according to the specification above. A second step 58 of the method is donning the harness 12. A third step 60 of the method is engaging each cuff 16 to an associated wrist. A fourth step 62 of the method is running. While running, the bands 14 help to train the runner to maintain each forearm at a 90° angle relative to the upper arm.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A running form training device comprising:

a harness configured for donning by a user, such that the harness is removably engaged to a torso of the user;

a pair of bands, the bands being resiliently stretchable, each band being engaged to the harness, such that the band extends from proximate to a front of a respective shoulder of the user, wherein the bands comprise elastomer, silicone, or rubber;

a pair of cuffs, each cuff being engaged to a first end of a respective band and being configured for removably engaging a respective wrist of the user, wherein the bands are configured for drawing the arms of the user toward the harness for restricting movement and positioning of the aims for promoting proper running form;

wherein the harness comprises:

a belt configured to be tightened around a waist of the user, and a pair of chest straps, each chest strap extending from a forward section to a rearward section of the belt;

wherein the chest straps are mutually engaged, such that each chest strap extends transversely across a back of the user;

a plurality of first connectors positioned on each of the chest straps; and a pair of second connectors, each second connector being engaged to a respective band, the second connector being complementary to the first connectors, such that the second connector is selectively engageable to a respective first connector for removably engaging the respective band to the harness.

2. The running form training device of claim 1, further including:

a first coupler engaged to a first endpoint of the belt; and a second coupler engaged to a second endpoint of the belt, the second coupler being complementary to the first coupler, such that the second coupler is selectively engageable to the first coupler for fastening the belt around the waist of the user.

3. The running form training device of claim 2, wherein the second coupler and the first coupler comprise a side release buckle, such that the belt is selectively sizable to fit the waist of the user.

4. The running form training device of claim 1, wherein the cuff comprises:

a wrist strap; and a pair of fasteners, each fastener being engaged to the wrist strap proximate to a respective opposed end of the wrist strap, the fasteners being selectively mutually engageable for fastening the cuff around the respective wrist of the user.

5. The running form training device of claim 4, wherein the pair of fasteners comprises a hook and loop fastener, such that the cuff is selectively sizable to fit the respective wrist of the user.

6. The running form training device of claim 1, wherein the plurality of first connectors comprises four first connectors positioned two-apiece on each chest strap.

7. The running form training device of claim 1, wherein:
the second connector comprises a carabiner; and
the respective first connector comprises a D-ring.

8. A running form training device comprising:

a harness configured for donning by a user, such that the harness is removably engaged to a torso of the user, the harness comprising:

a belt configured to be tightened around a waist of the user, a first coupler engaged to a first endpoint of the belt, a second coupler engaged to a second endpoint of the belt, the second coupler being complementary to the first coupler, such that the second coupler is selectively engageable to the first coupler for fastening the belt around the waist of the user, the second coupler and the first coupler comprising a side release buckle, such that the belt is selectively sizable to fit the waist of the user, and a pair of chest straps, each chest strap extending from a forward section to a rearward section of the belt, the chest straps being mutually engaged, such that each chest strap extends transversely across a back of the user;

a pair of bands, the bands being resiliently stretchable, the bands comprising elastomer, silicone, or rubber, each band being engaged to the harness, such that the band extends from proximate to a front of a respective shoulder of the user;

a plurality of first connectors engaged to the chest straps, the plurality of first connectors comprising four first connectors positioned two- apiece on each chest strap;

a pair of second connectors, each second connector being engaged to a respective band, the second connector being complementary to the first connectors, such that the second connector is selectively engageable to a respective first connector for removably engaging the respective band to the harness, the second connector comprising a carabiner, the respective first connector comprising a D-ring;

a pair of slip rings, each slip ring being engaged to a respective second connector, a respective band being positioned through the slip ring;

a pair of slide buckles, each slide buckle being engaged to a respective band defining a loop, such that the respective band is engaged to a respective slip ring, and such that the respective band is selectively length adjustable; and a pair of cuffs, each cuff being engaged to a first end of a respective band and being configured for removably engaging a respective wrist of the user, wherein the bands are configured for drawing the arms of the user toward the harness for restricting movement and positioning of the arms for promoting proper running form, the cuff comprising:

a wrist strap, and a pair of fasteners, each fastener being engaged to the wrist strap proximate to a respective opposed end of the wrist strap, the fasteners being selectively mutually engageable for fastening the cuff around the respective wrist of the user, the pair of fasteners comprising a hook and loop fastener, such that the cuff is selectively sizable to fit the respective wrist of the user.

* * * * *